US010036266B2

(12) United States Patent
Fishler

(10) Patent No.: US 10,036,266 B2
(45) Date of Patent: Jul. 31, 2018

(54) METHOD AND APPARATUS FOR TURBO-MACHINE NOISE SUPPRESSION

(75) Inventor: Benjamin E. Fishler, San Diego, CA (US)

(73) Assignee: United Technologies Corporation, Farmington, CT (US)

( * ) Notice: Subject to any disclaimer, the term of this patent is extended or adjusted under 35 U.S.C. 154(b) by 1831 days.

(21) Appl. No.: 13/351,455

(22) Filed: Jan. 17, 2012

(65) Prior Publication Data

US 2013/0183135 A1 Jul. 18, 2013

(51) Int. Cl.
*F01D 9/04* (2006.01)

(52) U.S. Cl.
CPC ..... *F01D 9/045* (2013.01); *F05D 2240/127* (2013.01); *F05D 2260/96* (2013.01)

(58) Field of Classification Search
CPC ..... F04D 29/66; F04D 29/661; F04D 29/663; F04D 29/665; F04D 29/667; F05D 2250/50; F05D 2250/51; F05D 2250/511
USPC ..... 415/119, 220, 219.1, 224.5, 203, 224, 415/222
See application file for complete search history.

(56) References Cited

U.S. PATENT DOCUMENTS

| | | | | |
|---|---|---|---|---|
| 2,959,917 | A * | 11/1960 | McGehee | 239/265.17 |
| 4,239,452 | A | 12/1980 | Roberts, Jr. | |
| 4,738,586 | A | 4/1988 | Harter | |
| 4,844,695 | A | 7/1989 | Banks et al. | |
| 6,375,416 | B1 | 4/2002 | Farrell et al. | |
| 6,382,905 | B1 | 5/2002 | Czachor et al. | |
| 6,464,489 | B1 | 10/2002 | Gutmark et al. | |
| 6,698,209 | B1 | 3/2004 | Gutmark et al. | |
| 7,237,378 | B2 | 7/2007 | Lardellier | |
| 7,320,574 | B2 | 1/2008 | Greim et al. | |
| 8,066,096 | B1 | 11/2011 | Francisco et al. | |

FOREIGN PATENT DOCUMENTS

JP 2007077860 A * 3/2007

OTHER PUBLICATIONS

English Machine Translation of JP 2007-77860 A, Sep. 25, 2014, JPO/INPIT.*

* cited by examiner

*Primary Examiner* — Woody Lee, Jr.
*Assistant Examiner* — Adam W Brown
(74) *Attorney, Agent, or Firm* — Carlson, Gaskey & Olds, P.C.

(57) ABSTRACT

A turbo-machine inlet includes a gas passage having a non-gradual bend prior to an impeller assembly. The non-gradual bend causes a localized shockwave in fluid flowing through the gas passage.

17 Claims, 4 Drawing Sheets

METHOD AND APPARATUS FOR TURBO-MACHINE NOISE SUPPRESSION

TECHNICAL FIELD

The present disclosure relates generally to noise suppression in turbo-machines, and particularly to noise suppression in an inlet shroud for a centrifugal impeller turbo-machine.

BACKGROUND OF THE INVENTION

Operation of turbo-machines, such as centrifugal impeller turbo-machines, generates significant amounts of acoustic noise. A dominant portion of acoustic noise generated by a centrifugal turbo-machine is due to an impeller blade rotating at a high rpm, which causes a high pressure side and a low pressure side to develop on the leading edge of the blade. This pressure differential generates pressure perturbations which propagate back upstream through the gas passage at the blade passing frequency, radiating out the fluid passage inlet of the turbo-machine as acoustic noise.

Multiple attempts have been made in the art to reduce this noise via the inclusion of inlet silencers. Inlet silencers are primarily effective in a lower frequency range than the frequency range of noise generated by the impeller blades. Other attempts at reducing the noise have resulted in unacceptable reduction in the performance of the turbo-machine.

SUMMARY OF THE INVENTION

Disclosed is a gas inlet for a turbo-machine having a gas passage including an impeller, the gas passage is bounded on one side by an inlet shroud, the gas passage has an at least partially radial fluid flow inlet relative to the impeller, and the gas passage has at least a first axial fluid flow portion relative to the impeller, the at least partially radial fluid flow inlet connected to the first axial flow portion via a non-gradual bend in the fluid passage, and wherein an arc angle of the non-gradual bend and strong curvature is sufficient to generate a shockwave extending a portion of a distance from a first side of the gas passage at an exit of the bend toward a second side of the gas passage at the exit of the bend.

Also disclosed is a turbo-machine having an inlet shroud defining a first wall of a gas passage, an impeller assembly having a gas passage, with an at least partially radial fluid flow inlet relative to the impeller assembly, and at least a first axial fluid flow portion, the at least partially radial fluid flow inlet connected to the first axial flow portion via a non-gradual bend in the gas passage, and wherein an arc angle of the non-gradual bend is sufficient to generate a shockwave extending a portion of the distance from a first side of the gas passage at an exit of said bend toward a second side of the gas passage at an exit of the bend.

Also disclosed is a method for reducing noise in a turbo-machine having the step of generating a shockwave in a fluid passage of a turbo-machine, thereby blocking upstream propagation of pressure perturbations in a fluid passing through the gas passage.

These and other features of the present invention can be best understood from the following specification and drawings, the following of which is a brief description.

DETAILED DESCRIPTION

Figure 1:
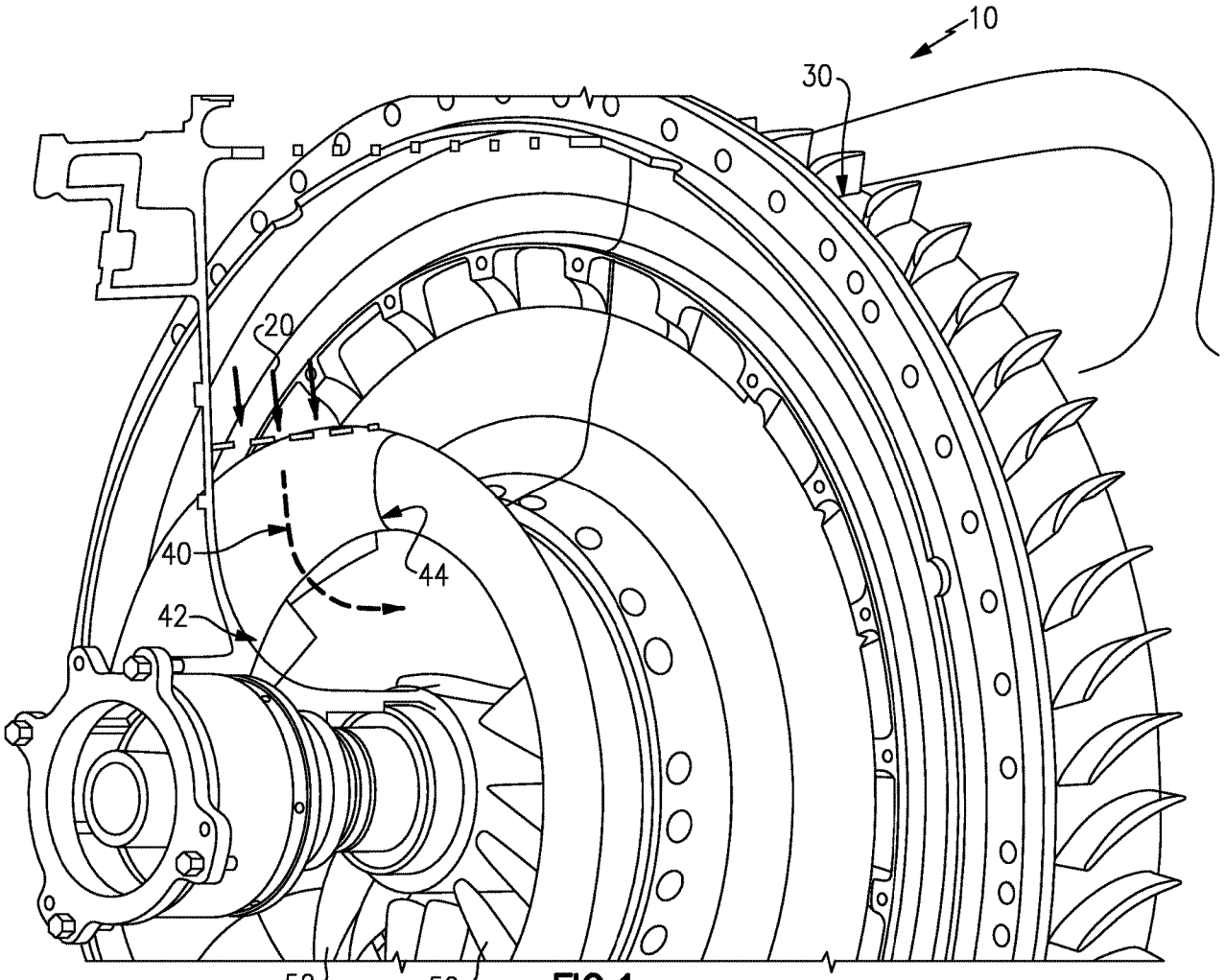
FIG. 1 illustrates an internal schematic drawing of a turbo-machine.

FIG. 1 illustrates a compressor assembly 10 of a turbo-machine having a gas path inlet 20 and a gas path outlet 30. A shroud wall contour line 44 and a hub wall contour line 42 are included to illustrate hub and shroud walls, as illustrating the actual hub and shroud would obscure the internal components. An impeller wheel is located between the gas path inlet 20 and a gas path outlet 30 within a compressor assembly 10. The impeller draws air through the inlet 20 and forces air out of the outlet 30. Rotation of impeller blades 52 within the compressor assembly 10 at the normal operating speeds generates pressure perturbations at the blade passing frequency in the air flow through the gas path 40. The pressure perturbations propagate upstream through the gas path 40 to the gas path inlet 20, and emanate from the inlet 20 as acoustic noise to the far-field.

Figure 2:
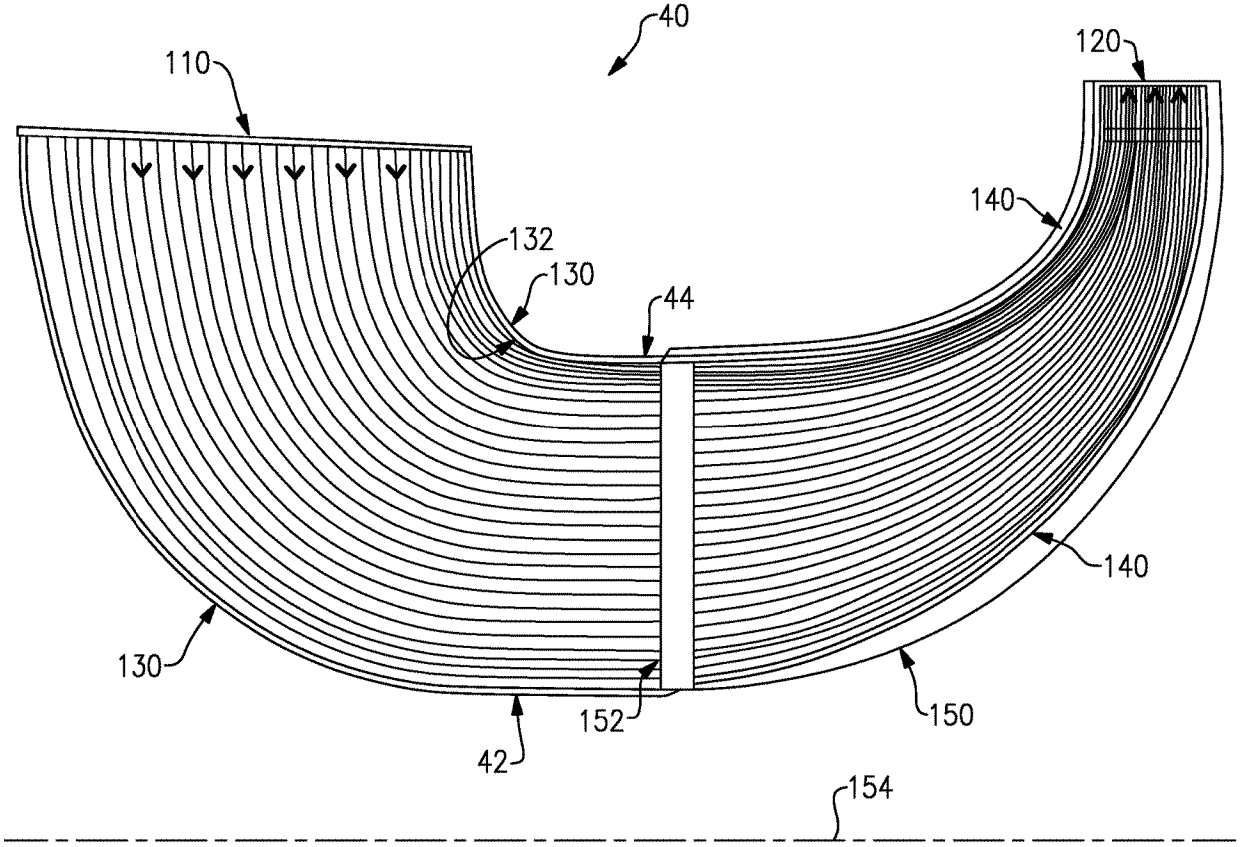
FIG. 2 illustrates a meridional view of a turbo-machine fluid passage.

FIG. 2 illustrates a meridional schematic view of the gas path 40. The gas path 40 includes a hub side 42 and a shroud side 44. When referencing fluid flowing through the gas path 40, fluid flowing immediately adjacent to the shroud side 44 is referred to as being at 100% span and fluid flowing immediately adjacent to the hub side 42 is referred to as being at 0% span. By way of example, fluid flowing through the quarter of the gas path 40 closest to the shroud side 44 is referred to as flowing through the 75%-100% span region. Fluid flowing approximately parallel to a wall of the gas path 40 and adjacent to the wall (very near 100% span or 0% span) is referred to as being attached to the wall.

Fluid, such as air, enters the gas path 40 at a fluid inlet 110, travels through the gas path 40, and is expelled at a fluid outlet 120 of the impeller 150. Fluid travels through both the fluid inlet 110 and the fluid outlet 120 radially relative to the centerline 154 of an impeller wheel 152. The gas path 40 includes a radial to axial bend 130, where fluid flow transitions from traveling radially relative to an impeller wheel 152 axis centerline 154 to traveling axially relative to the impeller wheel 152 axis centerline 154. An axial to radial bend 140 transitions the fluid flowing through the gas path 40 back to a radial flow direction relative to the impeller 150 prior to the fluid flow passing through the outlet 120. While the illustrated example illustrates a purely radial inflow at the inlet 110, alternate gas path 40 configurations with a partial radial inflow can also be utilized with the present description.

The impeller 150 is located in the axial flow portion of the gas path 40. The impeller 150 includes multiple rotating impeller blades 52 (illustrated in FIG. 1), which draw air through the gas path 40 from the inlet 110 to the outlet 120. The rotation of the impeller blades 52 also generates periodic pressure perturbations in the fluid flowing through the gas path 40. The pressure perturbations propagate upstream to the fluid inlet 110 where they are output as acoustic noise.

The magnitude of the acoustic intensity vector generated at a given point of the fluid flow can be calculated using the following equation:

$$I = \left[\bar{v}\cdot u' + \frac{p'}{\bar{\rho}}\right]\left[\bar{\rho}u' + \left(\frac{\bar{v}\bar{\rho}}{\sqrt{p}}\right)p'\right]$$

[Morfey, C. L., 1971 "Acoustic energy in nonuniform flows", J. Sound ib., 14, pp. 159-170.]

In the above equation "I" is an instantaneous acoustic intensity vector at a particular point, and is made up of Ix, Iy, and Iz components. "$\bar{V}$" is a time-averaged velocity vector of the fluid, and is made up of Vx, Vy, and Vz components. "u'" is the, irrotational component of a velocity perturbation vector, and is made up of Vx', Vy', and Vz' components. "P'" is an instantaneous component of pressure perturbation and is a scalar value. "$\bar{\rho}$" is a time averaged density of pressure perturbations and is a scalar value.

Once the instantaneous acoustic intensity vector (I) is determined, the total sound power through a plane can be determined using the following formula:

$$P=\int_S \bar{I}\cdot dS$$

In the above equation, "P" is a total sound power, "I" is a time-averaged acoustic intensity vector, and "dS" is a normal vector times a discretized cell face area.

A full 3D computational fluid dynamics (CFD) simulation run with a structured grid representing the geometry depicted gas path 40 in FIG. 2 along with application of the above formulas using the extracted solution variables demonstrates that the majority of the pressure perturbations propagate in the 50%-100% span region of the gas path 40.

The radial to axial bend 130 of the gas path includes an aggressive, non-gradual, curvature (i.e. a "knee" type bend) on the shroud side of the radial to axial transition region, while maintaining a gradual curvature in the hub side of the radial to axial transition region. The knee bend causes a shockwave to be generated in the fluid flow when the fluid encounters the knee bend. The shockwave extends down from the shroud side 44 of the gas path 40 toward the hub side 42. By way of example, the shockwave can extend through the 100%-50% region of the gas path 40.

The distance between the knee bend 132 and the impeller 150 is a sufficient length to allow fluid flowing through the gas path 40 to reattach to the inner surface of the gas path 40 on the shroud side 44 prior to entering the impeller 150. Once reattached, the fluid flows into the impeller 150 with normal streamlines in the meridional plane relative to the impeller 150. By allowing the fluid flow to reattach to the shroud side 44 prior to entering the impeller 150 at the leading edge of the impeller wheel 152, performance degradation resulting from the shockwave is reduced to a minimal amount, and can be as low as a 0.1% to 0.2% efficiency reduction of the turbo-machine.

Figure 3:
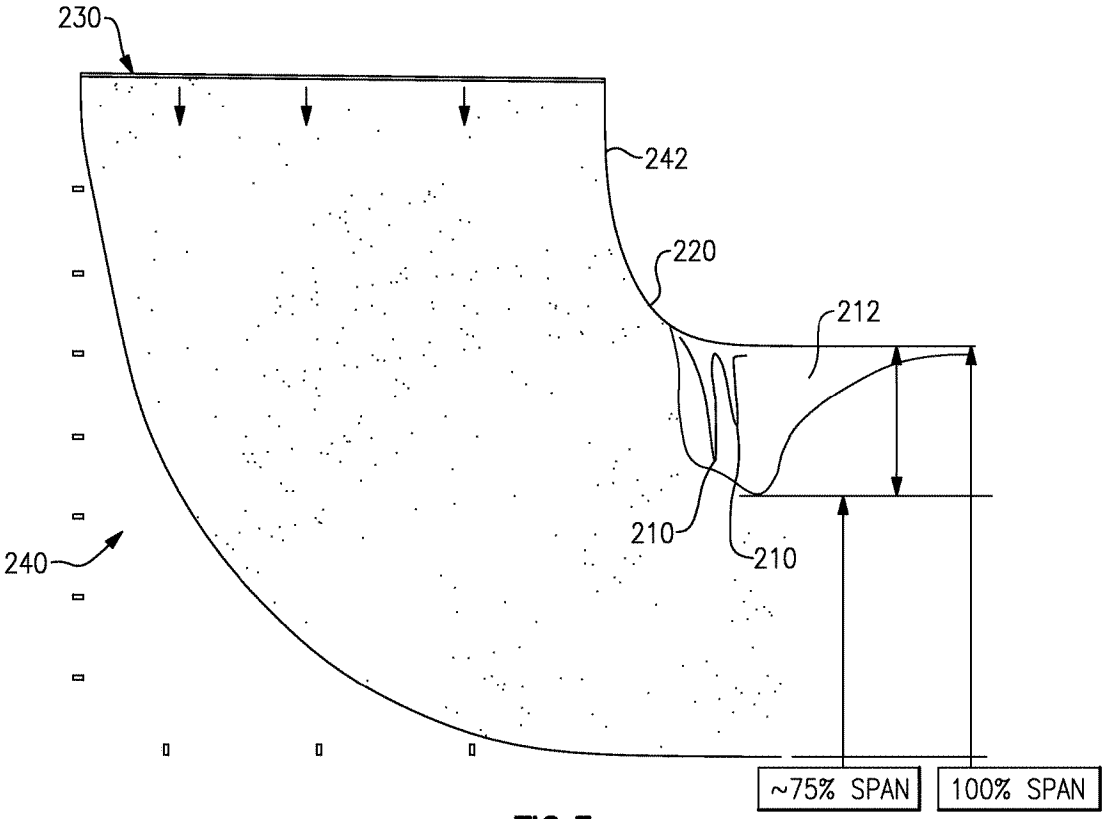
FIG. 3 illustrates a cross sectional view of the fluid passage of FIG. 2.

FIG. 3 illustrates a cross sectional view of a gas path 240 with a pair of shockwaves 210 induced by locally accelerated flow due to a knee bend 220, such as the knee bend described above with reference to FIG. 2. While the present example illustrates two shockwaves, a knee bend could be designed to implement a different number of shockwaves. The width of the illustrated shockwaves is exaggerated for illustrative effect. Fluid flowing in via an inlet 230 encounters the knee bend 220, and locally accelerates enough to reach supersonic mach numbers, resulting in a localized abrupt change in flow quantities in a flow disturbance region 212. The illustrated shockwaves 210 extends through the 100%-75% span region, and block acoustic noise causing pressure perturbations from traveling back upstream in the 100%-75% span region. Alternately, the knee bend 220 can be designed such that the shockwave extends through the 100%-50% span region, thereby increasing the amount of pressure perturbations that are blocked by the shockwaves 210. The curvature of the knee bend 220 determines the span depth of the shockwaves 210, with deeper shockwaves 210 requiring more distance between the fluid flow to reattach to the shroud side fluid gas path surface. The particular arc angle of the knee bend can be adjusted for any specific application to generate a desired shockwave.

Figure 4:
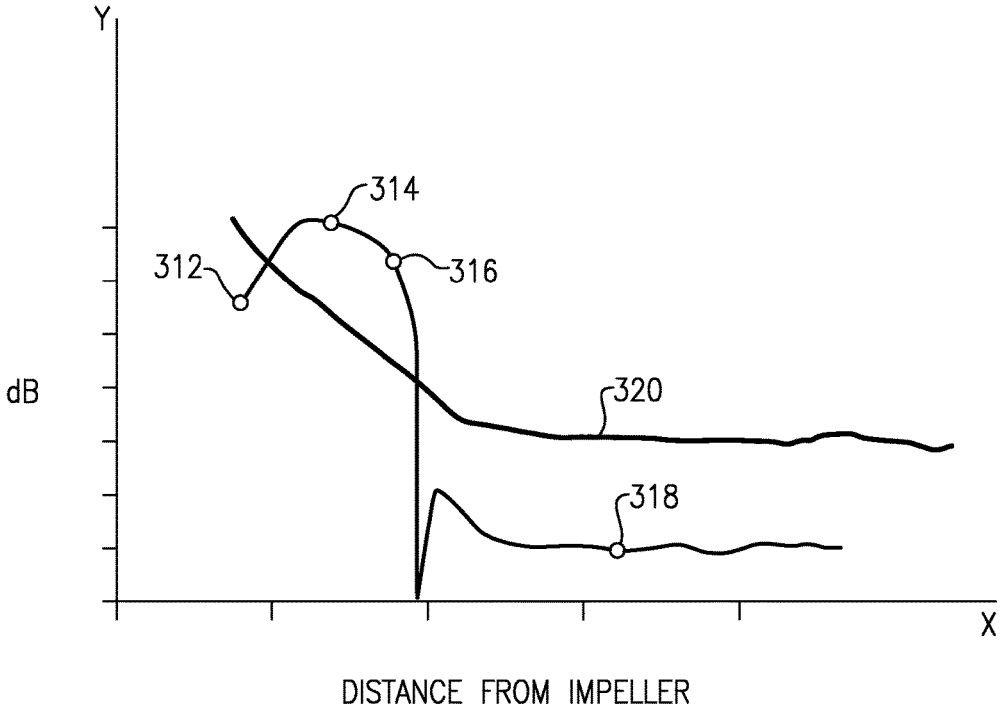
FIG. 4 illustrates a sample graph of sound power with respect to distance from the leading edge of an impeller apparatus in the gas path along the shroud contour.

FIG. 4 is a sample graph showing acoustic sound power of pressure perturbations (in dB SWL, sound watt level) on the y axis, and distance from the impeller leading edge along the curvilinear coordinate of the meridional shroud on the X axis. As can be seen in the graph, the acoustic sound power immediately adjacent to the impeller apparatus starts at a high level (point 312) and eventually begins to decrease in a non-linear region. As the gas path approaches the radial to axial transition region, i.e. the knee bend, (point 314) the sound power begins to decline more rapidly up until the edge of the shockwaves 210, illustrated in FIG. 3, closest to the impeller apparatus (point 316). Once reaching the shockwave, the sound power decreases dramatically before leveling off at a significantly lower sound power (point 318) than would be achieved with the gradual reduction in sound power present without the shockwaves 210. Also illustrated in FIG. 4 is a baseline 320 illustrating the acoustic sound power of pressure perturbations for a similar system without a knee bend.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gas inlet for a turbo-machine comprising:

a gas passage including an impeller, the gas passage being bounded on a first side of the gas passage by an inlet shroud defining a shroud side and bounded on a second side of the gas passage by a hub wall defining a hub side, the gas passage including an at least partially radial fluid flow inlet relative to said impeller, and the gas passage including at least a first axial fluid flow portion relative to a centerline of said impeller;

said at least partially radial fluid flow inlet connected to said first axial flow portion via a non-gradual bend in said fluid passage; and wherein an arc angle of said non-gradual bend is sufficient to generate a shockwave extending a portion of a distance from the first side of said gas passage at an exit of said non-gradual bend toward the second side of said gas passage at said exit of said non-gradual bend.

2. The gas inlet of claim 1, wherein said first side of said gas passage at the exit of said non-gradual bend is a shroud side of said gas passage, and said second side of said gas passage at the exit of said non-gradual bend is a hub side of said gas passage.

3. The gas inlet of claim 1, wherein said impeller is positioned in said first axial fluid flow portion of said gas passage.

4. The gas inlet of claim 3, wherein said impeller extends from said shroud side of said gas passage to said hub side of said gas passage.

5. The gas inlet of claim 3, wherein said impeller is oriented such that fluid flowing through said gas passage passes through said impeller approximately normal to said impeller.

6. The gas inlet of claim 1, wherein said shockwave generated by said non-gradual bend extends at least 50% of a distance from said first side of said gas passage to said second side of said gas passage.

7. The gas inlet of claim 1, wherein said shockwave extends through a 100%-50% region of said gas passage, wherein fluid flowing immediately adjacent the shroud side is 100% span and fluid flowing immediately adjacent the hub side is 0% span, and the 100%-50% region extends halfway from said shroud side toward said hub side.

8. The gas inlet of claim 1, wherein said shockwave extends through a 100%-75% region of said gas passage, wherein fluid flowing immediately adjacent the shroud side is 100% span and fluid flowing immediately adjacent the hub side is 0% span, and the 100%-75% region extends one quarter of a distance from said shroud side toward said hub side.

9. The gas inlet of claim 1, wherein said shockwave is operable to block the dominant portion of pressure perturbations generated in a fluid flowing through said fluid passage by said impeller, thereby minimizing acoustic noise output at said inlet.

10. A turbo-machine comprising:

an inlet shroud defining a first wall of a gas passage, said gas passage having an impeller assembly, an at least partially radial fluid flow inlet relative to said impeller assembly, and at least a first axial fluid flow portion;

said at least partially radial fluid flow inlet connected to said first axial flow portion via a non-gradual bend in said gas passage; and wherein an arc angle of said non-gradual bend is sufficient to generate a shockwave extending a portion of the distance from a first side of said gas passage at an exit of said non-gradual bend toward a second side of said gas passage at an exit of said non-gradual bend.

11. A method for reducing noise in a turbo-machine comprising the step of:

blocking back flow of pressure perturbations in a fluid passing through a fluid passage by generating a shockwave in the fluid passage.

12. The method of claim 11, wherein said step of generating a shockwave comprises generating a shockwave in at least a 75%-100% region of said fluid passage, wherein fluid flowing immediately adjacent a shroud side is 100% span and fluid flowing immediately adjacent a hub side is 0% span, and the 100%-75% region extends one quarter of a distance from said shroud side toward said hub side.

13. The method of claim 11, wherein said step of generating a shockwave comprises generating a shockwave in at least a 50%-100% region of said fluid passage, wherein fluid flowing immediately adjacent a shroud side is 100% span and fluid flowing immediately adjacent a hub side is 0% span, and the 100%-50% region extends halfway from said shroud side toward said hub side.

14. The method of claim 11, further comprising the step of:

allowing a fluid flow in said fluid passage to reattach to an inner surface of said fluid passage after said fluid passes said shockwave, and prior to said fluid flow entering an impeller assembly.

15. The method of claim 14, wherein said fluid flow enters said impeller assembly approximately normal to said impeller assembly.

16. The turbo-machine of claim 10, wherein a shroud side wall of the non-gradual bend has a continuous arc angle.

17. The gas inlet of claim 1, wherein a shroud side wall of the non-gradual bend has a continuous arc angle.

* * * * *